United States Patent [19]

Bond

[11] 4,167,104

[45] Sep. 11, 1979

[54] SOLENOID ENABLED LOCK FOR VENDING MACHINES AND THE LIKE

[75] Inventor: Charles E. Bond, Goshen, Ohio

[73] Assignee: Coca-Cola Bottling Works Company, Cincinnati, Ohio ; a part interest

[21] Appl. No.: 853,251

[22] Filed: Nov. 21, 1977

[51] Int. Cl.[2] ..... E05B 47/00

[52] U.S. Cl. ..... 70/208; 70/282

[58] Field of Search ..... 70/208, 278, 280, 281, 70/282, 283

[56] References Cited

U.S. PATENT DOCUMENTS

| | | | |
|---|---|---|---|
| 2,910,859 | 11/1959 | Allen | 70/283 |
| 3,151,698 | 10/1964 | Pollock | 70/280 |
| 3,834,198 | 9/1974 | Wiczer | 70/208 |

*Primary Examiner*—Robert L. Wolfe

*Attorney, Agent, or Firm*—Melville, Strasser, Foster & Hoffman

[57] ABSTRACT

A solenoid enabled draw lock for securing a cabinet door to a vending machine cabinet and the like to prevent pilferage of the cabinet's contents. A door-mounted solenoid actuated dead bolt extends through coaxial apertures in the lock housing, lock cylinder and handle to permit extension of the lock handle only when the solenoid is retractably energized and otherwise restrains the handle in its retracted position.

4 Claims, 2 Drawing Figures

SOLENOID ENABLED LOCK FOR VENDING MACHINES AND THE LIKE

BACKGROUND OF THE INVENTION

1. Field of the Invention

The present invention relates generally to locks for securing cabinet doors to vending machine cabinets, and more specifically to a draw lock actuatable only upon the retraction of a solenoid operated dead bolt associated therewith.

2. Description of the Prior Art

It has long been known to use draw locks and the like to secure cabinet doors to vending machine cabinets to protect the cabinet's contents, both merchandise and currency, from pilferage. Such locks generally require the use of a key which permits a recessed handle to pop out from the machine. The handle may then be grasped and rotated to release the cabinet door and gain access to the cabinet's interior.

While such locks have proven difficult to pick and relatively resistant to forcible entry, there have recently been an increasing number of vending machine thefts where it appears that a master or duplicate key was used to open the draw lock and gain access to the cabinet's contents. Thefts involving such techniques are extremely difficult to detect and have resulted in a large loss of merchandise and revenue for the machine's owner.

While various solutions have been suggested for this problem, such as periodically changing the lock combination, such solutions have not proven effective and have placed unnecessary burdens on the vending machine owners to police the integrity of their machines.

SUMMARY OF THE INVENTION

The present invention provides means which can be added to existing vending machine draw locks to increase their effectiveness and prevent unauthorized entry to the machines. In particular, the present invention provides a solenoid operated dead bolt extending through coaxial apertures in the lock housing, lock cylinder and handle to permit extension of the lock handle only when the solenoid is actuated. Thus, even if a would-be thief succeeds in gaining possession of the proper key to open the lock, the solenoid operated dead bolt will not permit extension of the draw lock handle until the solenoid has been activated by a separately operated key or decoding device.

DESCRIPTION OF THE PREFERRED EMBODIMENTS

Figure 1:
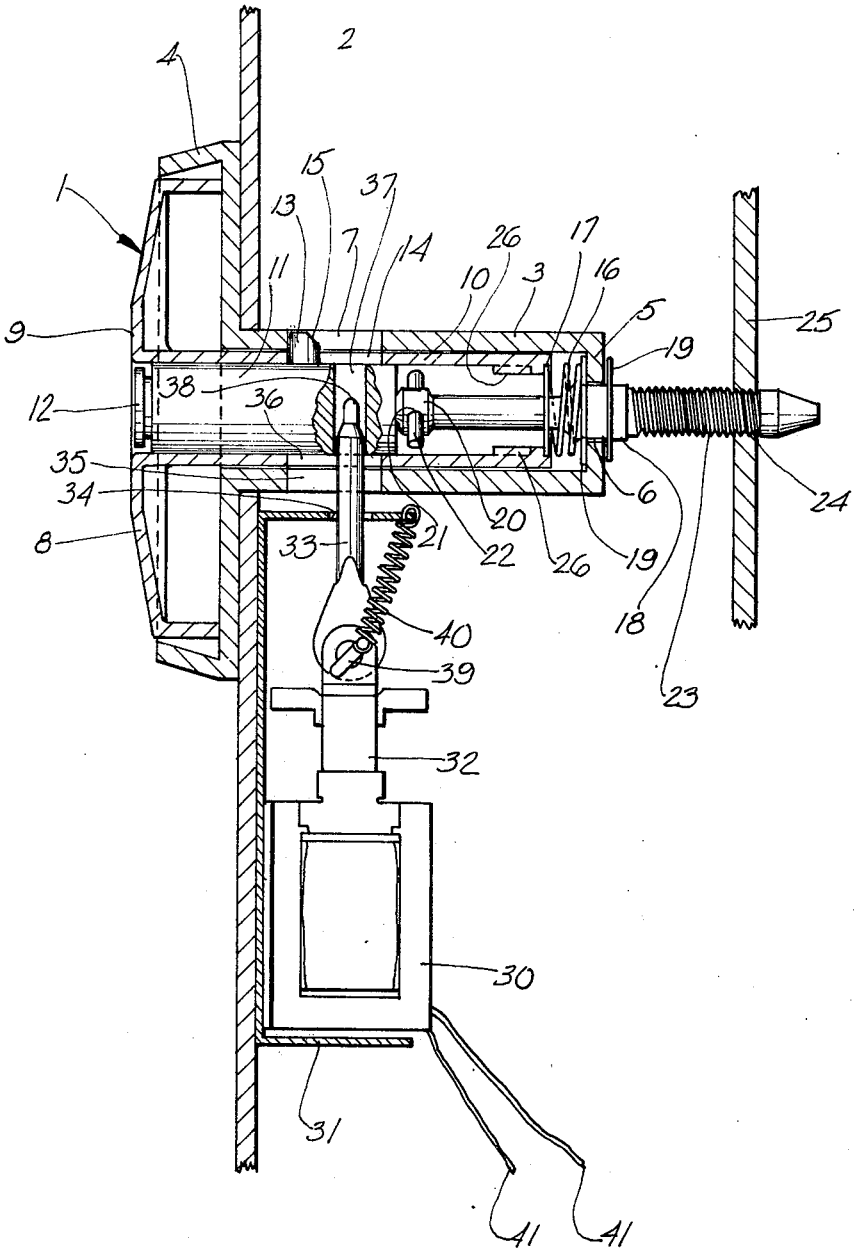
FIG. 1 is a fragmentary side elevation view, partially in cross section, of the solenoid enabled draw lock of the present invention shown in the deenergized or locked condition.

FIG. 1 illustrates a typical draw lock, shown generally at 1, attached to the cabinet door 2 of a typical vending machine cabinet or the like (not shown). Such locks are well known in the art and need be only briefly described to provide a complete understanding of the present invention.

Lock 1 comprises a hollow cylindrical lock housing 3 non-rotatably secured to and extending through cabinet door 2. Hollow cylindrical lock housing 3 terminates at its forwardmost end in a shallow rectangular handle receiving recess or escutcheon 4. The rearmost end of lock housing 3 terminates in an inwardly directed shoulder 5 having a substantially circular aperture 6 therein. A latch receiving aperture 7 is provided in the upper surface of lock housing 3 and extends completely therethrough for accepting a latch bolt as will be described hereinafter.

Figure 2:
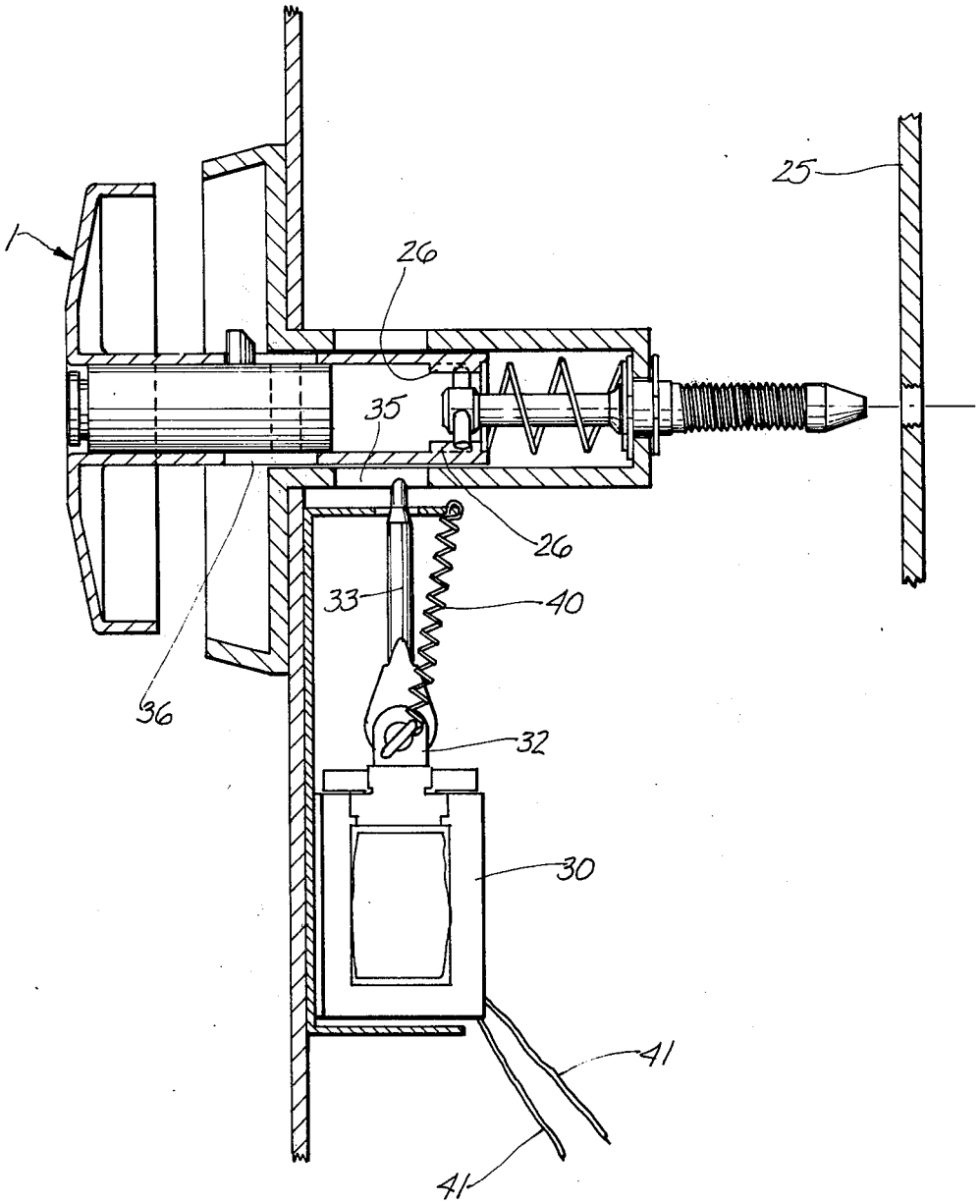
FIG. 2 is a fragmentary side elevation view, partially in cross section, of the solenoid enabled draw lock of the present invention in the energized or unlocked condition.

Lock 1 also includes a substantially T-shaped handle 8 having a forward portion 9 slidably received within escutcheon 4 and a hollow tubular rearward portion 10 slidably and rotatably received telescopically in lock housing 3. Handle 8 is movable between the retracted position shown in FIG. 1 wherein forward portion 9 is received within escutcheon 4 and the extended position shown in FIG. 2 wherein forward portion 9 is projected outwardly from escutcheon 4. Received within hollow rearward portion 10 of handle 8 is a cylindrical lock cylinder 11. The forwardmost end of lock cylinder 11 is approximately flush with the forward surface of handle 8 and contains a keyway 12 adapted to receive a suitably configured key (not shown). Lock cylinder 11 also contains an upwardly projecting latch bolt 13 extending through coaxial apertures 14 and 7 in handle 8 and lock housing 3, respectively, when lock 1 is in the locked position as depicted in FIG. 1. As is well understood in the art, upon insertion of a suitably configured key in keyway 12 of lock cylinder 11, and rotation of the key in the proper direction, latch bolt 13 will be caused to retract below the innermost surface of the rearward portion 10 of handle 8, thereby allowing handle 8 to slide outwardly, as shown in FIG. 2, until latch bolt 13 passes beyond the innermost surface of escutcheon 4. It will also be observed that latch bolt 13 contains a downwardly sloping chamfer 15 at its rearmost edge which assists in depressing latch bolt 13 below the innermost surface of lock housing 3 when handle 8 is returned to its retracted position.

To assist in extending handle 8 outwardly when latch bolt 13 has been retracted, a compression spring 16 is positioned between the inside surface 5 of lock housing 3 and a shoulder 17 circumscribed in the rearmost end of the rear portion 10 of handle 8. When latch bolt 13 is retracted, spring 16 urges handle 8 outwardly to the full length of spring 16 as shown in FIG. 2. Hence, in conventional draw bolt installations, handle 8 will automatically pop out for grasping when latch bolt 15 is retracted.

A substantially cylindrical draw member 18 is positioned coaxially within handle 8, lock housing 3 and compression spring 16, continuing outwardly from the rear end of lock housing 3. Draw member 18 is generally free to rotate, but is prevented from lateral movement along the axis of lock housing 3 by means of a pair of C-clips 19 positioned in annular grooves in draw member 18 on either side of shoulder 5 of lock housing 3. The forwardmost end of draw member 18 terminates in an annular shoulder 20 having an aperture 21 therein positioned transverse the axis of draw member 18. A pin 22 of a length slightly less than the inside diameter of rear portion 10 of handle 8 is positioned within aperture 21, such that pin 22 is transverse the axis of draw member 18. Pin 22 provides a stop for draw member 18 as will be described hereinafter.

The rearmost portion of draw member 18 terminates in threaded portion 23 which threadedly engages a threaded aperture 24 in bracket 25 (which may be rigidly attached to any portion of the vending machine cabinet, not shown) when lock 21 is in the locked position, as shown in FIG. 1.

When it is desired to unlock lock 1, latch bolt 15 is retracted as described hereinabove, causing handle 8 to pop outwardly. With handle 8 in the extended position, the forwardmost end 20 of draw member 18 assumes the position near the rearmost inside edge of rear portion 10 of handle 8. As is best shown in FIG. 2, this area of portion 10 of handle 8 contains a pair of diametrically opposed inwardly directed flanges 26 which non-rotatably engage the ends of pin 22. The extended portion of handle 8 may be grasped and rotated causing draw member 18 to rotate therewith. As draw member 18 is rotated in the proper direction, threaded portion 23 will become completely threadedly disengaged from bracket 25 as shown in FIG. 2, thereby permitting door 2 to be opened to gain access to the vending machine interior (not shown). To secure lock 1, the reverse procedure is followed. Door 2 is closed until threaded portion 23 of draw member 18 begins to engage threaded portion 24 of bracket 25. Thereafter handle 18 may be rotated in the opposite direction to that described hereinabove to draw the door 2 tightly shut as threaded portion 23 threadedly engages bracket 25. The foreward portion 9 of handle 8 is then aligned with escutcheon 4 and pushed inwardly until latch bolt 15 is aligned with it and enters apertures 7 and 14 in lock housing 3 and handle 8, respectively.

The operation and construction of the draw lock as described hereinabove is entirely conventional and well understood by those skilled in the art. Such a lock may be opened by anyone possessing a key having the proper configuration. The present invention, as described hereinafter, provides additional security for the cabinet's contents by including a second solenoid actuated locking mechanism which prevents extension of handle 8 until the solenoid has been energized.

As illustrated in FIG. 1, the draw lock improvement includes an electrically actuated solenoid 30 attached to a substantially C-shaped mounting bracket 31 by any convenient means, such as rivets or the like, which is in turn attached to the inner surface of cabinet door 2 adjacent the lower side of draw lock 1. In FIG. 1, solenoid 30 is illustrated in the deenergized position, wherein armature 32 is fully extended upwardly. A dead bolt 33 is attached at its lower end to the upper end of armature 32, and extends through an aperture 34 in the upper flange of bracket 31, continuing through coaxial apertures 35 and 36 in the lower surfaces of lock housing 3 and rear portion 10 of handle 8, respectively. Aperture 34 is dimensioned slightly larger than dead bolt armature 33 to permit some lateral movement of the dead bolt in the event of misalignment between the dead bolt and coaxial apertures 35 and 36. The upper end of dead bolt 33, which is tapered as at 38 to permit easy entrance into apertures 35 and 36, terminates in an opening 37 extending through lock cylinder 11. Thus, when armature 32 is fully extended as in FIG. 1, relative movement is prevented between lock housing 3 and rear portion 10 of handle 8.

In a preferred embodiment, dead bolt 33 is pivotally attached to armature 32 by means of a cotter pin 39 or the like in order to provide for slight misalignments between solenoid 30 and draw lock 1. A spring 40 is attached to the lower end of dead bolt 33 and the rearmost edge of flange 34 of bracket 31 to urge dead bolt 33 upwardly through the coaxial apertures described hereinabove. Thus, in the locked condition illustrated in FIG. 1, spring 40 is slightly extended to maintain dead bolt 33 fully disposed within apertures 35 and 36.

Electric current may be supplied to energize the solenoid 30 by means of leads 41 from a source of electrical power, not shown. When solenoid 30 is so energized armature 32 will be drawn inwardly and downwardly, as shown in FIG. 2, thereby withdrawing dead bolt 33 from within apertures 35, 36 and 37. Solenoid 30 will retain dead bolt 33 in this position as long as electric current is supplied to leads 41. With dead bolt 33 withdrawn, rear portion 10 of handle 8 may be moved relative to lock housing 3 to disengage lock 1 as described hereinbefore. With solenoid 30 energized, spring 40 is fully extended, thereby providing a force tending to urge dead bolt 33 upwardly when armature is released by disconnecting the source of electric current to leads 41.

In operation, beginning with lock 1 in the closed position as depicted in FIG. 1, solenoid 30 is energized to withdraw dead bolt 33 from apertures 35, 36 and 37. This may be accomplished by activating a concealed switch (not shown) positioned between solenoid 30 and a source of electrical current. Alternatively, a separate combination lock, such as that described in U.S. Pat. No. 3,812,403, issued May 21, 1974 to Klaus W. Gartner, entitled "Electronic Combination Lock Including Sequential Signal Generator and Signal Display", may be utilized to energize solenoid 30. Thereafter, lock 1 may be unlocked in the conventional manner to gain access to the interior of the vending machine cabinet. In locking the cabinet, the reverse procedure is followed, it being insured that dead bolt 33 is withdrawn when handle 8 is retracted into lock housing 3.

It will be understood that various changes in details, materials, steps and arrangements of parts, which have been herein described and illustrated in order to explain the nature of the invention, may be made by those skilled in the art within the principle and scope of the invention as expressed in the appended claims. For example, while for purposes of an exemplary showing the present invention has been described in combination with a draw lock of the type manufactured by Chicago Lock Co. under Part No. 4265, and described in more detail in U.S. Pat. Nos. 3,089,329, 3,089,330, 3,111,833 and 3,122,012, it will be understood that other types of draw locks may be utilized such as those described in U.S. Pat. Nos. 3,213,654, 3,222,899, 3,285,043, 3,299,678, 3,302,434 and 3,550,412, among others. In addition, while the solenoid operated dead bolt has been shown positioned beneath the draw lock, it will be understood that the solenoid operated draw bolt may be located at any position adjacent the draw lock, with the necessary changes made in the aperture orientation and mounting details.

The embodiments of the invention in which an exclusive property or privilege is claimed are defined as follows:

1. In a draw lock for securing a cabinet door to a cabinet comprising a hollow cylindrical lock housing non-rotatably secured to the door terminating at its forward end in a shallow rectangular handle receiving recess, said cylindrical housing containing an aperture extending therethrough for accepting a latch bolt, a retractable and extensible T-shaped member having a forward handle portion slidably received in said recess and a hollow tubular rearward portion slidably and rotatably received in said housing, said T-shaped member being movable between a retracted position wherein said handle portion is slidably received within said recess and an extended portion wherein said handle portion is projected outwardly from said recess, said T-shaped member including a lock cylinder received therein, the forward end of the said cylinder containing keyway means adjacent said handle portion for receiving a key, said cylinder including a latch bolt projecting outwardly therefrom through said hollow tubular rearward portion of said T-shaped member and adapted to engage said aperture in said housing when said T-shaped member is in said retracted position, said latch bolt being disengagable from said aperture to permit said T-shaped member to move from said retracted position to said extended position, means to urge said T-shaped member outwardly from said housing when said latch bolt is disengaged from said aperture, and a threaded draw member associated with said T-shaped member for threadedly engaging the cabinet to secure the door to the cabinet, the improvement in combination therewith comprising an electrically operated solenoid mounted proximate said lock, said solenoid having an armature linearly movable between an extended position when said solenoid is deenergized and a retracted position when said solenoid is energized, coaxial apertures extending through one side at least of said housing, said lock cylinder and said hollow tubular rearward portion of said T-shaped member, a dead bolt having a lock engaging end and a driven end pivotally connected to said armature so that said dead bolt is driven in a direction substantially parallel to the direction of travel of said solenoid armature but with the ability to pivot slightly with respect to said armature to compensate for minor misalignments between said dead bolt and said coaxial apertures, said lock engaging end being withdrawn from said coaxial apertures when said solenoid is energized and extended through said coaxial apertures into said lock cylinder when said solenoid is deenergized to prevent relative movement between said housing and said T-shaped member, and spring means attached to said dead bolt tending to urge said lock engaging end of said dead bolt toward said coaxial apertures.

2. The draw lock according to claim 1, wherein said lock engaging end of said dead bolt is tapered to permit easy entrance into said coaxial apertures.

3. The draw lock according to claim 1, wherein said solenoid is mounted on a bracket secured to said cabinet door, said bracket having an outwardly directed flange containing an aperture adjacent said coaxial apertures, said dead bolt passing through said aperture, said aperture being dimensioned to permit some lateral movement of said dead bolt therein.

4. The draw lock according to claim 3, wherein said spring means is attached at one end to said bracket and at the other end to the pivotal connection of said armature and said dead bolt.

* * * * *